United States Patent [19]

Crespiatico et al.

[11] Patent Number: 5,007,854

[45] Date of Patent: Apr. 16, 1991

[54] LOCKING DEVICE FOR CONNECTORS OF PRINTED CIRCUIT BOARDS

[76] Inventors: Giampietro Crespiatico, Via Dell'Aprica 26, 20158 Milano; Luciano Mondori, Via A. Righi 4, 20082 Binasco (MI), both of Italy

[21] Appl. No.: 520,688

[22] Filed: May 8, 1990

[30] Foreign Application Priority Data

Jun. 8, 1989 [IT] Italy ..... 20812 A/89

[51] Int. Cl.[5] ..... H01R 13/62

[52] U.S. Cl. ..... 439/367; 439/368; 439/347

[58] Field of Search ..... 439/367, 347, 78, 79, 439/350, 357, 368, 369

[56] References Cited

U.S. PATENT DOCUMENTS 4,168,877 9/1979 Little et al. ..... 439/347
4,598,962 7/1986 Reitz et al. ..... 439/367 X
4,640,562 2/1987 Shoemaker ..... 439/350 X
4,771,910 9/1988 Roy ..... 439/347 X
4,940,423 7/1990 Aihara et al. ..... 439/369

*Primary Examiner*—David L. Pirlot
*Assistant Examiner*—Julie R. Daulton
*Attorney, Agent, or Firm*—J. S. Solakian; J. H. Phillips

[57] ABSTRACT

A locking device for connectors of printed wired boards, the connectors being of EURODIN (DIN41612C/R) type, which device prevents the disconnection of two coupled connectors, consisting of a rectangular elongated plate in plastic material having four tenons at its corners in relief over said plate, the tenons inserting in end recesses of the connectors when the plate is overlapped to two coupled connectors, the plate further having two resilient end arms, perpendicular to the plate and extending in the same direction as the tenons, each arm having a locking tooth which hooks to the lower side of the connector pair when the plate is overlapped to the coupled connector pair.

1 Claim, 1 Drawing Sheet

LOCKING DEVICE FOR CONNECTORS OF PRINTED CIRCUIT BOARDS

FIELD OF THE INVENTION

This invention relates to a locking device for connectors of printed circuit boards, and, more particularly, to a locking device for assuring the reliable coupling of two printed circuit boards.

BACKGROUND OF THE INVENTION

In modern electronic systems, it is sometimes necessary to connect a pair of printed circuit boards in edge to edge alignment. One board is provided with a male connector for coupling with a corresponding female connector of the other board. Thus, the two boards are aligned each to the other in the same plane and connected together at a first edge. The connectors coupling together the two boards are typically of standard type, are located at such first edge and have an inserting direction perpendicular to the edge direction and parallel to the plane of the boards. One of the printed circuit boards may be, for example, an adapting board serving to couple the other printed circuit board to, again by way of example, a back panel. The connector for connection to the back panel is located at a second edge of the adapting board, opposite and parallel to the first one, and the inserting direction of this connector, for coupling to the back panel, is identical to the previous one.

It is known that, due to the friction and contact pressure exerted by electrical contacts, the insertion and disconnection operations involve a force acting on the connectors. Therefore, if a board pair of the exemplary type (that is, consisting of a printed circuit board coupled to a printed circuit adapting board) is pulled out of its housing, a pull has to be exerted on the first board to pull it out. Hence, there is the risk that the adapting board will remain inserted in the housing and disconnect itself from the first board while remaining connected to the back panel. Thereafter, the removal of the adapting board, for maintenance, testing or repairing, is difficult, if not impossible.

The present invention overcomes this problem and provides a locking device for printed circuit board connectors which is simple, inexpensive and reliable. Moreover this device may be used with standard connectors, in standard environment for such connectors, which standard is very restrictive in terms of encumbrance and space available among contiguous connectors. The locking device of the invention is further of advantage because it directly acts on the connectors, without interference with other elements and without imposing constraints additional to those imposed by the standards in the use of printed circuit boards and in the allocation thereon of electronic components.

DESCRIPTION OF THE DRAWING

The features and the advantages of the invention will appear more clearly from the following description of a preferred form of the invention and from the enclosed drawings where.

DETAILED DESCRIPTION OF THE INVENTION

Figure 1:
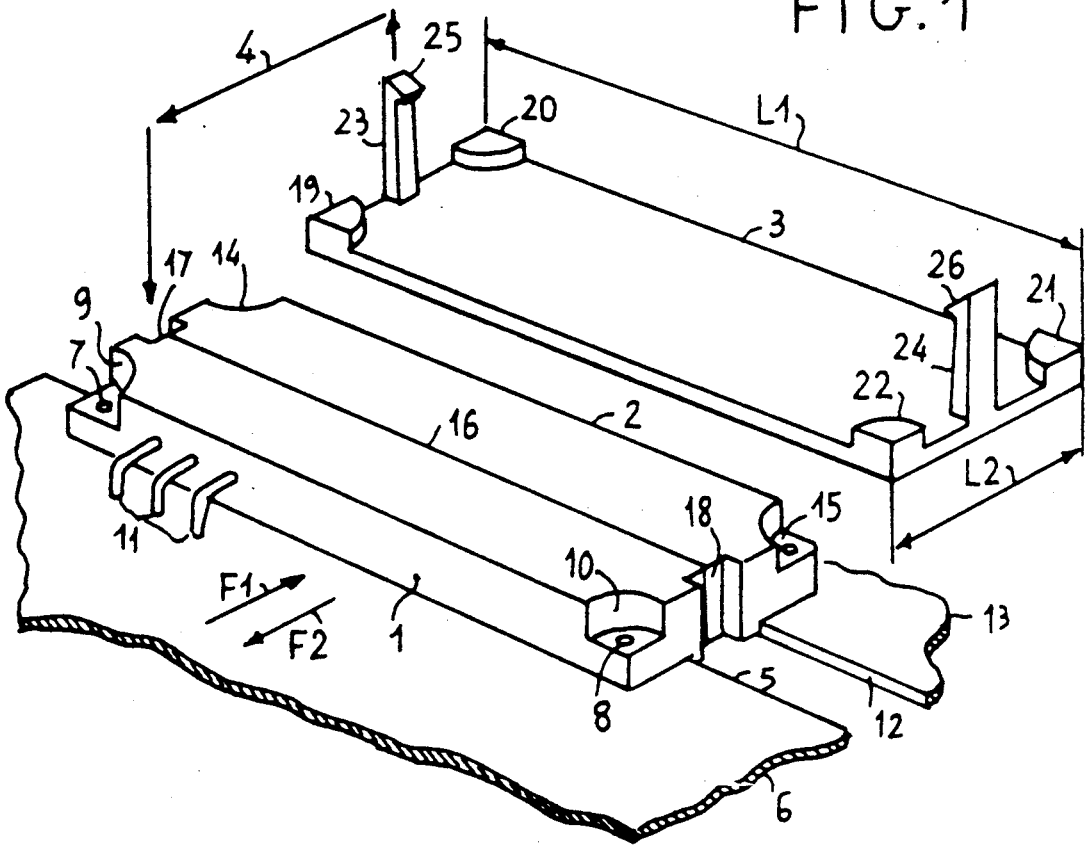
FIG. 1 is a perspective, exploded view of two connectors coupled each to the other and of a preferred embodiment for the locking device of the invention.

FIG. 1 shows, in an exploded perspective view, two coupled connectors 1, 2 and the locking device 3 of the invention. In FIG. 1, the locking device, relative to the connectors, is rotated 180° for a better view; the arrowed line 4 indicates the position which the device 3 has to take for performing the locking function. The connector 1, of standard type DIN416121 series C (male connector), is fixed to one edge 5 of a printed circuit board 6, by means of two screws or rivets 7, 8. The connector 1 has two recesses 9, 10 shaped as cylindrical segments which have a predetermined depth and are located at the corners where the rivets have to be inserted. These recesses are only partly occupied by the head of the fixing screws or rivets. Several conductive pins 11 protrude from the body of connector 1 and are conventionally fixed, by soldering, to conductive pads (not shown) located on the lower face of the printed circuit board 6.

Similarly, the connector 2, of standard type DIN41612 series R (female), is fixed to an edge 12 of a printed circuit board 13 by means of two screws or rivets whose head is housed in two recesses 14, 15 which are identical to recesses 9, 10.

The two connectors 1, 2 have substantially the same size and shape; that is, rectangular parallelepipeds elongated in one direction. They differ only in the out-of-view contacting and coupling portions, one connector being of the male type and the other of the female type. At the two ends of the connectors, which are elongated in the direction of the edges 5, 12, and adjacent to the mutual contact plane identified by line 16, the two connectors have two juxtaposed recesses forming two grooves 17, 18 disposed perpendicular to the plane of the boards. Arrow F1, located in the plane of printed wired board 6 and perpendicular to edge 5, shows the insertion direction for coupling connector 1 to connector 2. Obviously, connector 1 is disconnected from connector 2 by moving connector 1 in the direction opposite to that of arrow F1, relative to connector 2; that is, in the direction shown by arrow F2.

To avoid a force exerted on board 6 in the direction of arrow F2 (which force may occur when the pair of boards 6, 13 has to be pulled out of a housing, not shown) which may cause the disconnection of the two connectors, the locking device 3 is used. The locking device 3 consists of a generally rectangular plate, fabricated in a plastic insulating material, having a length L1 equal to the length of the connectors 1, 2 and a width L2 equal to the total width of the two coupled connectors in the insertion direction. The thickness of the plate of the device 3 is preferably between 2 and 5 mm, and it is provided at its corners with four tenons 19, 20, 21, 22 in the form of cylindrical sectors, similar to the form of recesses 9, 10, 14, 15 and differing only in height, the height of the tenons being less than the depth of the recesses.

It is clear that by rotating the device 3 through 180° in the direction shown by arrow 4 and superimposing it to the connectors 1, 2, the tenons 19, 20, 21, 22 insert each in a corresponding recess of the connectors and prevent the connectors from being detached each from the other. The generally rectangular device 3 is further provided, at its ends, with two prismatic tongues 23, 24 which are relatively resilient and terminate, at a distance from the plane of the board equal to the thickness of the connectors 1, 2, with a locking tooth 25, 26. The two tongues, or end arms, extend perpendicularly to the plane of the rectangular body of the device 3 in the same direction as the tenons. When the locking device is superimposed to the connectors, the tongues 23, 24 are inserted in grooves 17, 18 formed by the connector pair, and bend elastically until the teeth 25, 26 engage the lower face of the connectors. Tongues 23, 24 prevent the locking device, once fixed on the upper face of the connectors, from being casually lifted and removed.

Figure 2:
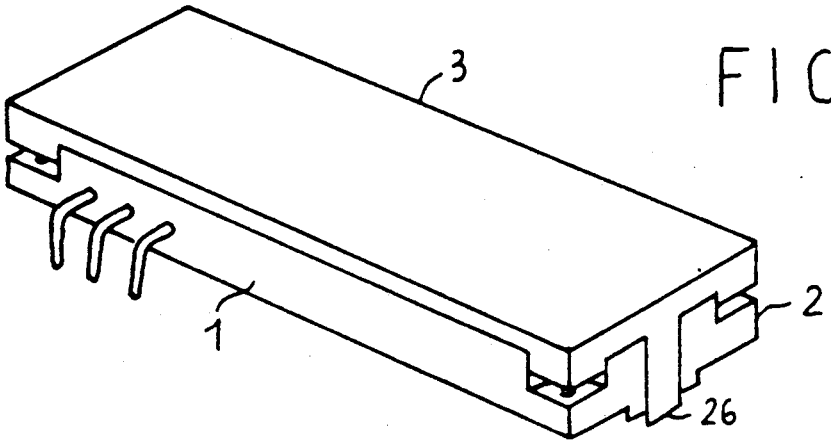
FIG. 2 is a perspective view of two connectors, with the locking device of FIG. 1 in operative position.

FIG. 2 shows, in perspective view, the set of the two connectors 1, 2 and the locking device 3 in operative position. From FIG. 2, it may be seen that the encumbrance of the locking device is minimum and enclosed in a prismatic volume which differs from the one of the connectors only by the thickness of the rectangular body and for the volume of the locking teeth 25, 26. These teeth may have a very small height, on the order of 2 mm, so as not to cause interference when a plurality of printed wire board pairs are inserted in a housing, side by side, at the distance of 20→32 mm each from the other, as determined by the standards.

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is:

1. The combination comprising a pair of connectors for printed circuit boards and a related locking device, each of said connectors:

(A) being shaped as a rectangular parallelepiped having a length, a width and a height, each of said connectors having:

(B) an insertion face disposed perpendicular to said width, (C) a lower surface for fixing to a printed circuit board, said lower surface being disposed perpendicular to said height, (D) an upper surface opposite said lower surface, and (E) a pair of angular recesses located on said upper surface at the two corners of said parallelepiped opposite to said insertion face, said pair of connectors being:

(F) coupled by mating of the respective insertion faces said locking device comprising:

(G) a rectangular, elongated plate having:

(1) a length equal to the length of said connectors, (2) a width equal to the encumbrance of a coupled pair of said connectors in the direction of said connector width, (3) upper and lower faces, (4) a tenon at each of its corners protruding from said lower face, and (5) two end arms situated intermediate the width of said plate and extending perpendicularly therefrom in the same direction as said tenons, each of said arms ending in a locking tooth, and (H) said plate being overlapped to said coupled connectors with its lower face overlaying said upper surfaces of said connectors, said tenons being inserted in said connector recesses and said end arms locking, with their respective teeth, said plate to said coupled connectors, thereby preventing disconnection of said coupled connectors and removal of said plate from said coupled connectors.

* * * * *